US007665736B1

(12) United States Patent
Ko

(10) Patent No.: US 7,665,736 B1
(45) Date of Patent: Feb. 23, 2010

(54) METHOD OF CONDUCTING A WAGERING GAME

(76) Inventor: Shenli Ko, 9873 Ashton Pines Ct., Las Vegas, NV (US) 89147

( * ) Notice: Subject to any disclaimer, the term of this patent is extended or adjusted under 35 U.S.C. 154(b) by 284 days.

(21) Appl. No.: 11/589,624

(22) Filed: Oct. 30, 2006

Related U.S. Application Data

(63) Continuation-in-part of application No. 11/482,675, filed on Jul. 6, 2006, now abandoned, and a continuation-in-part of application No. 10/647,940, filed on Aug. 25, 2003, now abandoned.

(60) Provisional application No. 60/788,678, filed on Apr. 3, 2006.

(51) Int. Cl.
*A63F 1/00* (2006.01)

(52) U.S. Cl. ..... 273/292; 273/274

(58) Field of Classification Search ..... 273/292, 273/274, 309; 463/13, 12
See application file for complete search history.

(56) References Cited

U.S. PATENT DOCUMENTS 6,206,373 B1 * 3/2001 Garrod ..... 273/292
2002/0008356 A1 * 1/2002 De Keller ..... 273/292

* cited by examiner

*Primary Examiner*—Benjamin H Layno
(74) *Attorney, Agent, or Firm*—Robert Ryan Morishita; Morishita Law Firm, LLC

(57) ABSTRACT

The present invention discloses a method of conducting a game, such as a game of poker, conducted in stages with a game decision performed at each game stage. A game wager is received and a game stage is conducted. After a game stage, a player decision of placing a wager or folding is received. After at least one additional game stage, a second game decision is received from a player electing to defer of folding or placing a re-entry wager. A game outcome is determined and the game is resolved.

27 Claims, 4 Drawing Sheets

METHOD OF CONDUCTING A WAGERING GAME

RELATED APPLICATION DATA

The present application is a continuation-in-part of U.S. application Ser. No. 10/647,940 filed Aug. 25, 2003, now abandoned, which claims the priority of U.S. Provisional Application Ser. No. 60/788,678, entitled "4 Card Hold'em Poker," filed Apr. 3, 2006 by Applicant herein, and is a continuation-in-part of U.S. application Ser. No. 11/482,675, entitled "Method of Conducting a Wagering Game," filed Jul. 6, 2006 now abandoned by Applicant herein.

FIELD OF THE INVENTION

The present invention relates to methods for conducting wagering games. More particularly, the present invention is a method conducting a staged wagering game.

BACKGROUND OF THE INVENTION

Texas Hold'em Poker has been very popular. As a result, there have emerged many derivatives of Hold'em Poker in hopes of riding its coattail. The majority of these games is played against a house dealer and goes as follows:

The dealer shuffles a complete deck of 52 playing cards. Each player makes an ante bet. Each player and the dealer are dealt two cards face-down. There is a round of "pre-flop" betting. The player is required to either fold and lose the ante bet or make an additional bet up to twice the ante. After the betting round ends, the dealer discards the top card of the deck and then deals the next three cards face up on the table. These cards are called the "flop." These are community cards that everyone can use in combination with his or her two hole cards to form a poker hand. Another round of betting may be conducted in which the player can fold, bet, or check (i.e. decline to bet but continue participation in the game). After the round of betting concludes, the dealer burns another card and deals a fourth community card onto the table. This is called the "turn card." Another round of betting may be conducted in which the player can check or bet, after which the dealer burns another card and deals a fifth community card onto the table. This is the "river card." In some variants of Texas Hold'em the dealer will deal the fourth and fifth cards together, resulting in one fewer round of betting. Each player uses any of the five community cards on the table and his or her two hole cards to form a five card poker hand. The dealer reveals his cards and likewise forms a five card poker hand using the five community cards and two dealer hole cards. The dealer compares his five card poker hand with each player's five card poker hand. The higher five card poker hand wins. If the player wins, he or she is rewarded; if the dealer wins, the player's ante wager along with any additional bets placed during the betting rounds are collected.

Currently the most popular of these variants is Texas Hold'em Bonus Poker. It is closest to the real Texas Hold'em Poker because of its multiple betting rounds and betting structure. The game begins with each player making an ante bet. The dealer deals each player and himself two hole cards. Now the player must either fold and lose the ante or place a second bet equal to twice the ante bet to stay in the game. The dealer then deals three community cards face up. The remaining players can either check or place a third bet equal to the ante. The dealer then deals the fourth community card. Each player again either checks or places a fourth bet equal to the ante. The dealer then deals the fifth and final card and reveals his-two hole cards. Whoever can form the best five card hand out of the seven cards (five community cards plus two hole cards) wins. A winning player hand is usually paid 1 to 1 on the total of the bets placed. However, if the player hand wins but is less than a straight or better, the player is only paid on the second through fourth bets, i.e. the player is not paid for the ante bet and the ante bet is simply returned. A different version requires the player hand to be a flush or better for the player to be paid for the ante bet.

Another hold'em variation is Ultimate Texas Hold'em™. The game begins with each player placing an ante and a blind bet. The ante and blind bets must be equal. Each player and the dealer receive two hole cards. Players can either check or make a play bet equal to four times the ante bet. The dealer deals a three-card flop of community cards. Players who did not place a play bet have the option to check or place a play bet equal to twice the ante. The dealer deals two final community cards. Players who have not placed a play bet have the option to fold or place a play bet equal to the ante. The dealer reveals his two hole cards and forms a hand using his hole cards and the community cards. If the dealer does not have at least a pair, the player's ante bet is returned but play proceeds with the play bets. If a player's hand formed using his hole cards and the community cards beats the dealer's hand, the player is paid even money on his play bet and ante bet (if it has not already been returned). If the dealer's hand beats the player's hand, the player loses. If player's hand ties the dealer's hand, the play and ante bets push. The blind bet is paid if the player's winning hand is a flush or higher; if the player's winning hand is lower than a flush, the blind bet pushes.

Another hold'em variant is World Poker Tour ("WPT") All-In Hold'em™. The game begins with all players making an ante bet. The dealer deals two hole cards to each player and the dealer. The player can (1) fold and lose the ante, (2) raise by betting five times the ante, or (3) go all-in and bet ten times the ante. The dealer then deals five community cards face-up and reveals the dealer's two hole cards. The players and the dealer form the best hand possible from five out of the seven cards (two hole cards and five community cards). A two-tiered dealer qualifying system comes into play when the dealer settles the bets. The sum of the dealer's two hole cards determines whether or not the dealer can qualify to play against all the bets, the raise bets (which were 5× the ante bet) or the all-in bets (which were 10× the ante bet). All face cards count as ten and aces count as eleven. If the dealer's two hole cards add up to twelve or less, then the dealer does not qualify to play against the players and the players are paid only on the ante bet with raise and all-in bets being returned. If the sum is thirteen to sixteen, then winning players are paid only on the ante bet and raise bets with all-in bets being returned.

Yet another hold'em variant is Riverboat Hold'em. Players make an ante bet. The dealer and each player then receive two hole cards. Players have the option to call, raise, or fold and lose the ante. If a player calls he must place a bet equal to the ante. If a player raises he must place a bet equal to twice the ante. The dealer then deals a three-card flop. Both the player and dealer will share these three community cards and make a five card poker hand with their two hole cads. The dealer must have a King-Jack or higher to qualify. If the dealer can't qualify all ante bets are paid 1 to 1. If the dealer qualifies, he will compare his hand with each player's hand and the higher hand wins. If the player hand outranks the dealer's hand, the player is paid even money on all bets. If the dealer hand outranks the player hand, the player loses all bets. In the event of a tie, the dealer wins.

What the majority of these games have in common is that players must fold if they do not want to risk additional bets to stay in the game. Sometimes they regret folding their hand after the dealer has revealed the flop because the two cards they folded, when combined with the flop, could have made a good hand.

What these games also have in common is that everyone makes their best five card poker hand out of a total of seven cards. Common observations are that casino dealers who are not poker dealers either have difficulty or are slow in identifying the best five of the seven cards. They make errors that annoy the players and cost the casinos money.

Furthermore, some of these games are expensive and intimidating to play owing to the quantity and size of bets the player is required to make. Some require five or six bet units per hand; others such as WPT All-In Hold'em™ require up to eleven bet units per hand. For example, a $10 ante means that an additional $100 bet must be made for the player to place the all-in bet. Many players are too intimidated to take the risk, even if the optimal play is to place the all-in bet. Consequently, many players lose the thrill of "winning big" and are unable to take advantage of the optimal play of the game.

Also, some of these hold'em variants require the player to make a bold betting decision after seeing just two of the seven cards they will have. These decisions involve making an additional bet that is several times their ante. With so little information available, it is a difficult decision which can be intimidating to make.

Moreover, some of these hold'em variants have multiple three betting rounds which necessitate memorizing up to three playing strategies. While the first strategy may be simple, as more cards are revealed the five and six card strategies become much more complicated. As nobody can memorize tens of thousands of playing decisions, the player will tend to lose more often than he should and feel that he cannot win the game.

SUMMARY OF THE INVENTION

In its broadest form, the present invention includes a method for conducting a multi-stage card game. A method according to the present invention includes receiving a game wager from each player for participation in the game. A first stage of the game is conducted. Optionally, the first stage includes dealing one or more player cards, one or more unexposed banker cards, and at least one community card, which may be exposed at the first stage. The quantity of cards dealt could vary; in one example, two player cards and two unexposed banker cards are dealt and one community card is exposed and in another example, three player cards and three unexposed banker cards are dealt and one community card is exposed.

After conducting the first stage, a game decision is received from each player. In one optional embodiment, the game decision allows the player to choose to place an additional game wager or fold and forfeit the game wager. If the player forfeits the game wager, participation by that player in the game is terminated.

After receiving the game decision, at least one additional stage of the game is conducted. Optionally, the additional stage includes exposing at least one additional community card. After conducting at least one additional stage, each player makes an additional game decision. In one optional embodiment, the additional game decision allows the player to place a second additional game wager or check. In an optional embodiment, folding is not an option in the additional game decision. Whether the player chooses to place a second additional game wager or check, the player of such an optional embodiment may continue participation in the game.

The outcome of the game is determined. The outcome of the game may take the form of a player winning outcome, a player losing outcome, or, in an optional embodiment, a tie outcome. More particularly, the outcome may be determined by exposing at least one additional community card and exposing the banker cards. A player hand formed from a subset of the player cards plus the community cards is compared to a banker hand formed from a subset of the banker cards plus the community cards. As noted above, the quantity of cards could vary; in one example, three community cards are exposed during the game such that the player hand is formed from three of the cards selected from the two player cards and three community cards and the banker hand is formed from three of the cards selected from the two banker cards and three community cards. In another example, three community cards are exposed during the game such that the player hand is formed from four of the cards selected from the three player cards and three community cards and the banker hand is formed from four of the cards selected from the three banker cards and three community cards.

The game is resolved by issuing a reward to the player based on the game wager, the additional game wager, and the second additional game wager if the player hand outranks the banker hand, or collecting the game wager, the additional game wager, and the second additional game wager from the player if the banker hand outranks the player hand.

For example, in one optional embodiment, a pay table of payouts and associated player hands is defined. In such an optional embodiment, the reward includes a payout from the pay table based on the player hand and the game wager. In such an optional embodiment, the additional game wager and second additional game wager, if any, may also be paid as part of the reward. In one optional embodiment, the reward includes a payout of even money on the additional game wager and second additional game wager, if any. In a further optional embodiment, if the banker cards are equal to, or greater than, a predetermined rank, the reward includes a payout of even money based on the additional game wager and the second additional game wager, if any, but if the banker cards are less than a predetermined rank, the reward includes only a return of the additional game wager and the second additional game wager, if any, to the player.

In an optional embodiment, where the outcome is a tie outcome, the game wager plus the additional game wager plus any second additional game wager is returned to the player. In another optional embodiment, the game wager, additional game wager, and second additional game wager, if any, are collected when the outcome is a tie outcome.

The method may also include an optional bonus wager. In one such optional embodiment, a player may place a bonus wager before the first stage. The player hand is compared to a bonus pay table defining bonus hands and associated bonus awards. If the player hand is a bonus hand, the associated bonus award is issued to the player.

In a particular embodiment applied to a card game conducted in two or more stages, a game wager is received from each player for participation in the card game. A first stage of the card game is conducted. The first stage includes dealing a player hand of cards, dealing a banker hand of cards, and revealing at least one community card.

After the first stage, a first game decision is received from each player. The first game decision is a decision to forfeit the game wager and terminate play of the card game or place an additional game wager.

After receiving the first game decision, a second stage of the card game is conducted by revealing at least one additional community card. After the second stage of the card game, each player makes a second game decision. The second game decision by these players is a decision to place a second additional game wager or check (i.e. not place any supplemental game wager) and continue participation in the card game.

After receiving the second game decision, at least one additional stage of the card game is conducted. Each additional stage includes revealing at least one additional community card and, after revealing at least one additional community card, receiving an additional game decision from each player continuing participation in the card game. In this optional embodiment, the additional game decision is a decision to place a supplemental game wager or check and continue participation in the card game.

The outcome of the card game is determined for each player by forming a final player hand from a combination of the player hand and the community cards, forming a final banker hand from a combination of the banker hand and the community cards, and comparing the final player hand with the final banker hand according to a predefined ranking. If the final player hand outranks the final banker hand the outcome is a player winning outcome. If the final banker hand outranks the final player hand the outcome is a player losing outcome.

The game is resolved by issuing a reward based on at least the game wager plus the additional game wager and any second additional game wagers to players with a player winning outcome, and collecting the game wager and the additional game wager and any second additional game wagers from players having a player losing outcome.

DESCRIPTION

Figure 3:
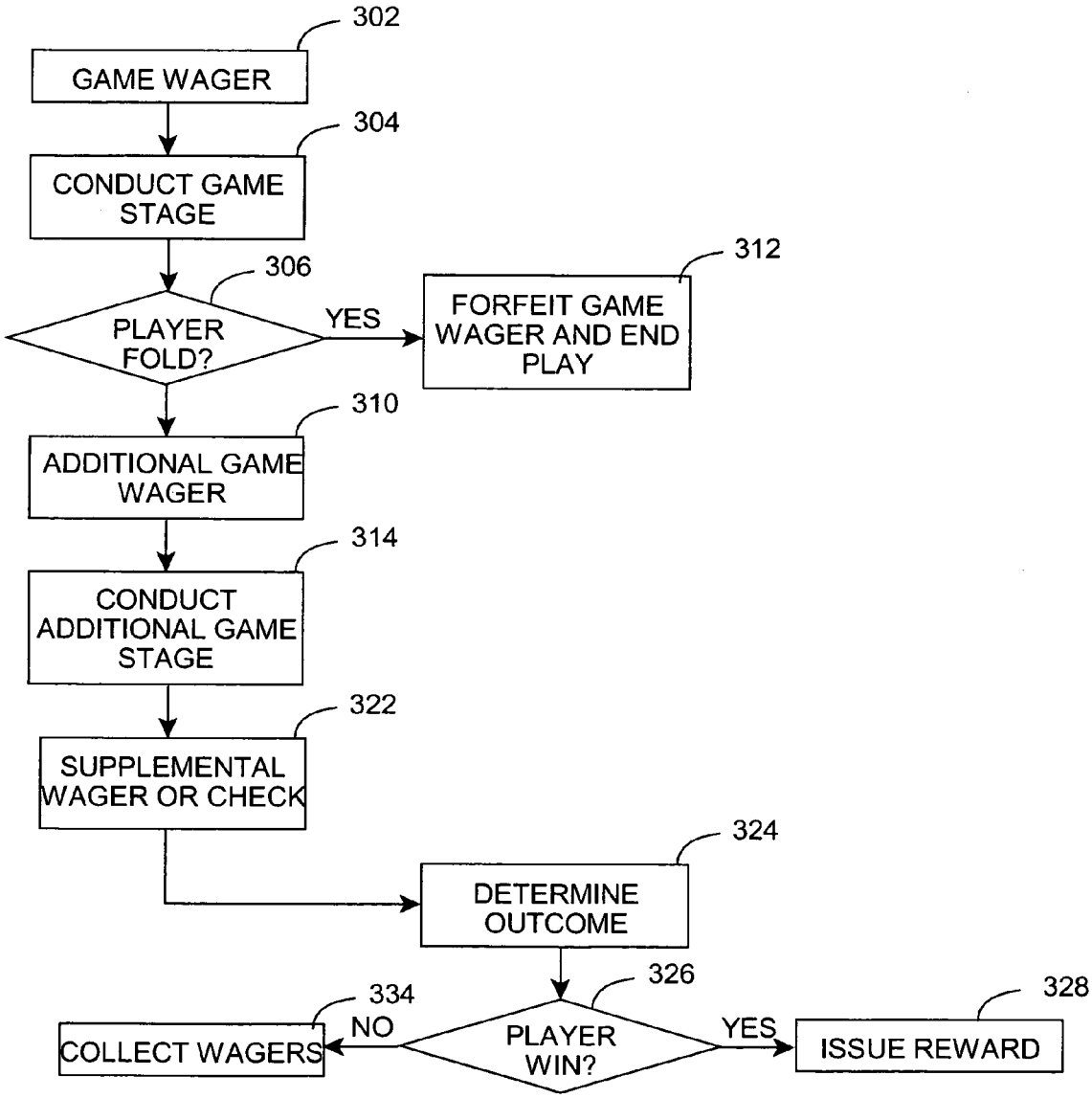
FIG. 3 is a flowchart of a method according to an optional embodiment of the present invention.

Reference is now made to the figures wherein like parts are referred to by like numerals throughout. Referring initially to the flowchart of FIG. 3, the invention disclosed herein is a method of conducting a game in stages. The game could take any form, including a table game, a gaming machine game, a virtual table game conducted over a computer network such as the Internet, a game played over a mobile device, or any other form of game. Additionally, the game could be player-banked or house-banked and could use any form of gaming equipment, including playing cards, tiles, dice, or any other form of gaming indicia, or electronic representations thereof. For example, in one optional embodiment described in greater detail below, the game could be a card game conducted between a banker and at least one player, utilizing community cards, banker cards, and player cards. In another optional embodiment, the game could be a card game conducted between two or more players, utilizing community cards and player cards.

The game includes each player placing 302 a game wager for participation in the game. A game stage is conducted 304. In an optional embodiment applied to a card game, a game stage may include revealing or dealing game indicia such as playing cards, slot symbols, tiles, or the like.

After the first stage, players make a first game decision. Optionally, the first game decision is a choice to place an additional game wager 310 or fold 306 (i.e. terminate play of the game and forfeit the game wager). If the player chooses to fold, the player forfeits 312 his or her game wager and play by that player is terminated.

After each player has made the first game decision, at least one additional stage of the game is conducted 314. After the additional stage is conducted, a second game decision must be made. In an optional embodiment, the second game decision may be to place 322 a second additional game wager (in addition to the game wager and additional game wager already placed) or check, i.e. place no supplemental game wager but continue participation in the game.

In an optional embodiment, additional game stages may be conducted. These additional game stages could take any form, but in one optional embodiment, the additional game stages include additional betting rounds where the player may elect to place more supplemental wagers or check (continue participation in the game without placing any more supplemental wagers). Although not shown in the examples below, in a further optional embodiment, the players may have additional options, such as folding.

An outcome of the game is determined 324 and wagers are resolved. As may be appreciated, the outcome may take the form of a player winning outcome, a player losing outcome, or, in an optional embodiment, a tie outcome. If the outcome is a player winning outcome 326, players are rewarded. In an optional embodiment, players are rewarded 328 based on the game wager plus the additional game wager plus any second additional game wager placed. Conversely, if the outcome is a losing outcome, wagers are collected 334. In an optional embodiment, this includes collecting all wagers placed including any game wager, any additional game wager, and any second additional game wager that the player may have placed.

In an optional embodiment, tie outcomes are permitted. In one such optional embodiment (not shown) a tie outcome may result in a push in which all wagers are returned. In an alternate optional embodiment (not shown), a tie outcome may result in the player losing, i.e. the house collecting, the player's game wager, additional game wager, and any second additional game wager.

More particularly, in an optional embodiment applied to a card game played between a banker and one or more players, each player placing a game wager may be dealt one or more player cards. In this optional example, the banker may be a house banker, a player-banker, or the like. A first game stage may also include revealing at least one community card available for use by any player and the banker and dealing one or more banker cards. The number of community cards may vary. Additionally, the quantity of community cards exposed may vary, including exposing none of the community cards at the first stage, but only revealing the community cards at later stages.

Continuing with the example, in one optional embodiment, upon viewing their player cards and any exposed community cards, players may place an additional game wager of a pre-specified multiple of the first game wager or may fold. If the player folds, the player's game wager is collected.

An additional game stage is conducted in which at least one community card is revealed. After this additional game stage, the player makes an additional game decision in which the player may place a second additional game wager or check, i.e. continue participation without placing more wagers.

In one example, additional game stages may be conducted if additional community cards are to be revealed. These additional game stages may also include additional game decisions where the player may choose to place more game wagers or check. In an optional embodiment, qualification by the player and/or the banker may be required to participate in a stage (whether the first stage or additional stages). Additionally or alternatively, qualification by the player may be required to receive a winning outcome. Qualification may be based on any criterion or criteria, such as the player cards, the player hand, the banker cards, the banker hand, the community cards, or the like.

An outcome is determined by exposing the banker cards, exposing any remaining community cards, and forming a player hand for comparison to a banker hand. In an optional embodiment, the player hand is formed from the player cards and the community cards and a banker hand is formed from the banker cards and the community cards. The final player hand is compared to the final banker hand according to a predetermined ranking to determine whether the player wins, loses, or, in an optional embodiment, ties. If the final banker hand outranks the final player hand, the player loses and the player's wagers are collected.

Figure 4:
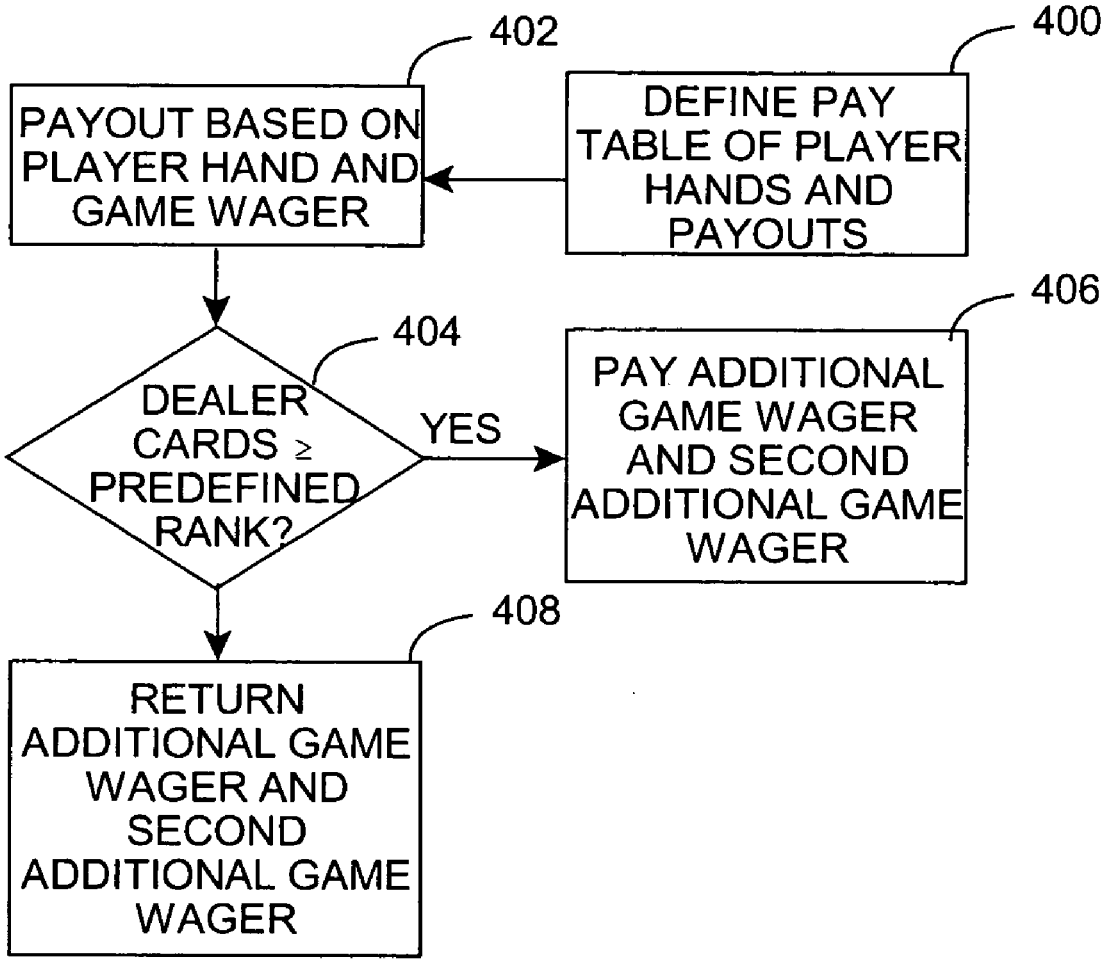
FIG. 4 is a flowchart of a method according to an optional embodiment of the present invention.

If the final player hand outranks the final banker hand, the outcome is a player winning outcome and the player is rewarded. Optionally, the reward is based on the player's game wager, additional game wager, and second additional game wager, if any. The reward may take any form. In one optional embodiment, the reward for the player's game wager is determined using a pay table of player hands and associated payouts. In a further optional embodiment, illustrated in FIG. 4, the reward may include a payout 402 based on a defined 400 pay table of player hands and associated payouts for the game wager, and a reward based on the banker cards for the additional game wager and second additional game wager. In this example, a winning player is rewarded 406 on his or her additional game wager and second additional game wager, if any, if the banker cards are equal to or greater than 404 a predetermined rank, such as a hand holding at least an Ace and a King, whereas if the banker cards are less than a predetermined rank, a winning player only receives a return 408 of his or her additional game wager and second additional game wager.

In another example embodiment, players may play against one another rather than against a banker. In one such optional embodiment, a first stage includes dealing player cards to each player. After conducting the first stage, each player may place an additional game wager or fold and forfeit the player's game wager. It is noted that the additional game wagers may be aggregated with the game wagers to form a pot. An additional stage of the game is conducted by exposing at least one community card. This may be the first community card exposed or it may be in addition to one or more community cards exposed in the first stage. After the additional stage, each player may make an additional game decision of placing a second additional game wager or checking. Additional stages may be conducted with exposing more cards and receiving additional game decisions.

When the community cards are exposed, each player forms a player hand from a subset of each player's player cards plus the community cards. The player hands are compared to determine the highest ranking player hand. The player having the highest ranking player hand is rewarded; players not having the highest ranking player hand lose their wagers.

The game method of the present invention could take many different embodiments, including the examples given below. The following example embodiments are presented for illustrative purposes and should not be considered limiting.

Optional Three Card Hold'em Embodiment

Figure 1:
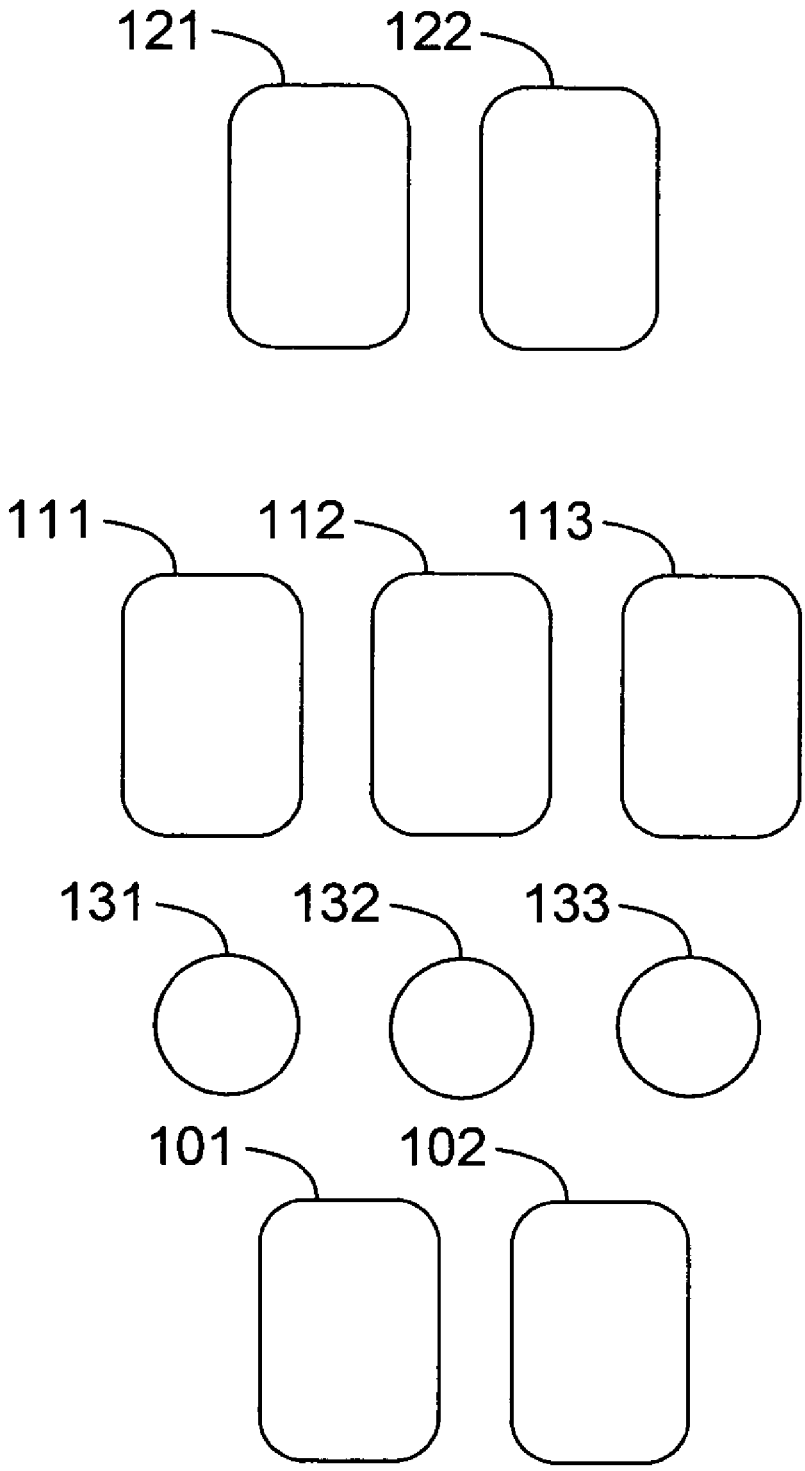
FIG. 1 is a top view of a table layout according to an optional embodiment of the present invention.

Referring to FIG. 1, the playing area includes player card locations 101-102, banker card locations 121-122, community card locations 111-113, and player wager locations including a game wager location 131, an additional game wager location 132, and a second additional game wager location 133.

Players place a game wager. Each player and the banker are dealt a hand of two hole cards. In this example, the player cards are dealt to player card locations 101-102 and the banker cards are dealt (optionally unexposed) to banker card locations 121-122. Three community cards are dealt unexposed to community card locations 111-113 and, in this example, one of the community cards is revealed. After looking at the cards of his or her player hand and the face-up community card, each player has the option to (a) fold and lose the first game wager or (b) place an additional game wager. In this example, the additional game wager is equal to the game wager.

A second community card is revealed. After this additional stage, players have the option to (a) check, i.e. continue participation in the game without placing any more wagers, or (b) place a second additional game wager equal to the game wager.

A third community card is revealed. At this point, in one optional embodiment, another round of wagering or checking could occur before the banker cards are revealed. In another optional embodiment, the banker cards are revealed without an additional round of wagering/checking. At this point, the players and the banker each have five cards—the two cards dealt plus the three community cards—from which to form a final hand. Each player and the banker form a final hand using any three of the five cards to make the best three-card poker hand possible.

The banker then compares the final banker hand with each final player hand. Hand rankings for this optional embodiment are shown below in descending order:

1) Straight Flush
2) 3 of a Kind
3) Straight
4) Flush
5) One Pair
6) High Card

The hand with the higher three-card poker ranking wins and wagers are resolved:

1) If the final banker hand outranks or ties the final player hand, the player loses all wagers.

2) If the final player hand outranks the final banker hand, the player's first game wager is paid according to a predetermined pay table and the second game wager and third game wager, if any, are paid even money. In this example, the pay table can be as follows:

| Final Player Hand | Pay |
|---|---|
| AKQ Suited | 5 to 1 |
| Straight Flush | 2 to 1 |
| 3 of a Kind | 2 to 1 |
| Pair of 9s or better | 1 to 1 |
| All others | Return game wager |

Optional Four Card Hold'em Embodiment

Figure 2:
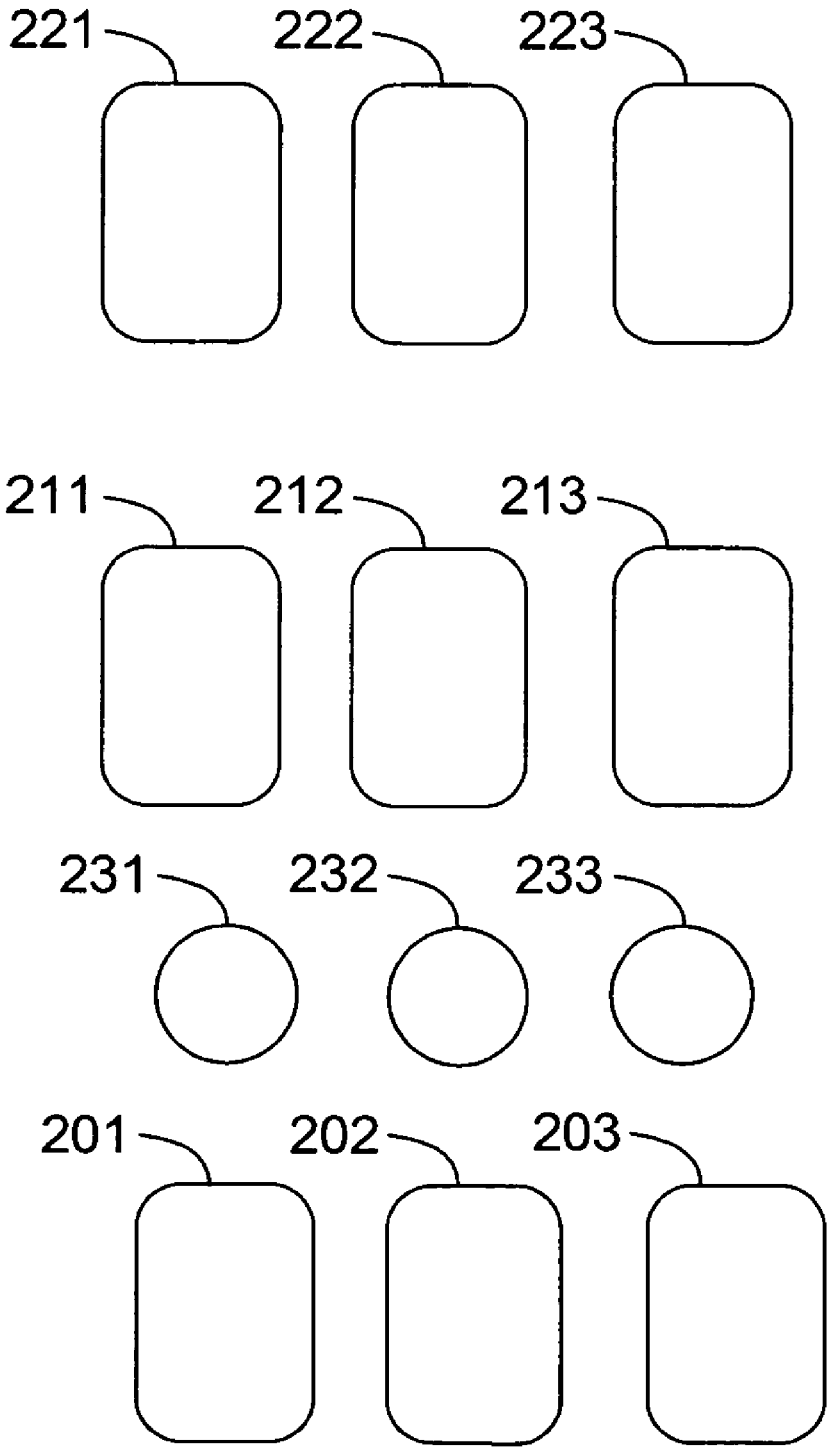
FIG. 2 is a top view of a table layout according to an optional embodiment of the present invention.

Referring now to FIG. 2, the playing area may include player card locations 201-203, banker card locations 221-223, community card locations 211-213, and player wager locations including a game wager location 231, an additional game wager location 232, and a second additional game wager location 233.

Players place a game wager. Each player and the banker are dealt three cards. In this example, the player cards are dealt to player card locations 201-203 and the banker cards are dealt to banker card locations 221-223. Three community cards are dealt face down to community card locations 211-213 and, in this example, one of the community cards is revealed. After looking at the cards of his or her player hand and the face-up community card, each player has the option to (a) fold and lose the first game wager or (b) place an additional game wager equal to the game wager.

A second community card is revealed. Players have the option to (a) check, i.e. continue participation in the game without placing any more wagers, or (b) place a second additional game wager equal to the game wager.

A third community card is revealed. Optionally, another round of wagering and/or checking may be conducted before the banker hand is revealed. In another optional embodiment, the banker hand of three cards is revealed without additional wagering and/or checking. At this point, the players and the banker each have six cards—the three cards dealt plus the three community cards—from which to form a final hand. Each player and the banker form a final hand using any four of the six cards to make the best four-card poker hand possible.

The banker then compares the final banker hand with each final player hand. Hand rankings for this optional embodiment are shown below in descending order:

1) 4 of a Kind
2) Straight Flush
3) 3 of a Kind
4) Flush
5) Straight
6) Two Pair
7) One Pair
8) High Card The hand with the higher four-card poker ranking wins and wagers are resolved:

1) If the banker hand outranks the player hand, the player loses all wagers.

2) If the player hand outranks the banker hand and the banker hand is Ace-King high or better, the player's first game wager is paid according to a predetermined pay table and the additional game wager and second additional game wager, if any, are paid even money. In this example, the pay table can be as follows:

| Final Player Hand | Pay |
|---|---|
| 4 of a Kind | 10 to 1 |
| Straight Flush | 3 to 1 |
| 3 of a Kind | 3 to 2 |
| Other | 1 to 1 |

3) If the final player hand outranks the final banker hand and the final banker hand is less than Ace-King high, the player's first game wager is paid according to the predetermined pay table above, and all other wagers are returned to the player.

In alternate optional embodiments, the qualifying banker hand rank can be different from Ace-King high. If the qualifying rank is higher, this may optionally permit greater pays for one or more rankings of final player hands.

4) If the final player hand and the final banker hand tie, all wagers push and are returned to the player.

Optional Four Card Hold'em Embodiment

In yet another optional embodiment, players place a first game wager. Each player and the banker are dealt two cards. Four community cards are dealt face down. Before any other community cards are revealed, each player has the option to (a) fold and lose the player's first game wager or (b) place an additional game wager equal to the game wager.

After each player has either wagered or folded, one of the community cards is revealed. After looking at the cards of his or her player hand and the face-up community card, each player has the option to (a) check, i.e. continue participation in the game without placing any more wagers or (b) place an additional game wager equal to the first game wager. Additional stages of revealing one or more community cards and rounds of wagering may follow until all the community cards are exposed. At this point, the players and the banker each have six cards—the two cards dealt plus the four community cards—from which to form a final hand. Each player and the banker form a final hand using any four of the six cards to make the best four-card poker hand possible.

The banker hand is compared with each player hand. Hand rankings for this optional embodiment are shown below in descending order:

1) 4 of a Kind
2) Straight Flush
3) 3 of a Kind
4) Flush
5) Straight
6) Two Pair
7) One Pair
8) High Card The hand with the higher four-card poker ranking wins. Where the banker hand and the player hand both use community cards exclusively, i.e. the four cards of the banker hand and the four cards of the player hand are derived solely from the four community cards, the higher card of the player cards is compared to the higher card of the dealer cards. The winning hand is determined by the card of higher value. Wagers are resolved:

1) If the banker hand outranks the player hand, the player loses all wagers.

2) If the player hand outranks the banker hand and the banker hand is a pair of Queens or better, the player's first game wager is paid according to a predetermined pay table and the additional game wager and second additional game wager, if any, are paid even money. In this example, the pay table can be as follows:

| Final Player Hand | Pay |
|---|---|
| 4 of a Kind | 4 to 1 |
| Straight Flush | 2 to 1 |
| Other | 1 to 1 |

3) If the player hand outranks the banker hand and the banker hand is less than a pair of Queens, the player's first game wager is paid according to the predetermined pay table above, and all other wagers are returned to the player.

In alternate optional embodiments, the qualifying banker hand rank can be different from a pair of Queens. If the qualifying rank is higher, this may optionally permit greater pays for one or more rankings of final player hands.

4) If the final player hand and the final banker hand tie, all wagers push and are returned to the player.

It is contemplated that any of the example embodiments given above or other optional embodiments could include many variations including:

(1) Player qualification for certain pays, where a player is rewarded on all wagers, i.e. the first game wager, the second game wager, and the third game wager, if any, if the player wins and has a final player hand of at least a predetermined ranking. If the final player hand is not at least a predetermined ranking, only the first game wager is paid if the player wins.

(2) Banker qualification for certain player pays, where a player is rewarded on all wagers if the player wins and the banker has a final banker hand of at least a predetermined ranking. If the final banker hand is not at least a predetermined ranking, only the first game wager is paid if the player wins.

(3) Defining a minimum banker hand, such that if the best final banker hand that can be formed from the banker hand and the community cards is of lower rank than the minimum banker hand, the banker augments the banker hand with one additional dealt card, and forms the final banker hand from the banker hand, the community cards, and the augmenting card.

In yet another optional embodiment, similar to a showdown or hold'em type poker game, the players may play against one another rather than against a dealer. In such an optional embodiment, a first stage may include dealing one or more player cards to each player. In such an optional embodiment, a player decision may be made after viewing the player cards in which the players may elect to wager or fold. In one optional embodiment, one or more community cards may be dealt and/or revealed before the player game decision, with other community cards dealt or revealed after the player game decision. In another optional embodiment, the player game decision occurs before any community cards are dealt, i.e. based solely on the player cards, and the community cards are revealed in stages after the player decision. The total cards, i.e. the cards dealt to the player plus the community cards, may vary according to the embodiment. For example, as described above and in my prior patent application, it is contemplated the player may form three, four, or five card hands from any number of cards allocated between player cards and community cards.

The player hands are compared to one another and the highest ranking player hand is rewarded based on his game wager, plus any additional game wagers. In an optional embodiment, the wagers are aggregated to a pot and the player with the highest ranking player hand is rewarded with at least a portion of the pot. Players not having the highest ranking player hand lose their wagers.

Bonus Wagers

In a three card embodiments of the present game, the player may also be given the option to place a bonus wager before any cards are dealt. In one optional embodiment, the bonus wager is rewarded if the player's best three-card, or in four-card in one case, poker hand forms a bonus combination. An example bonus pay table for the bonus wager can be as follows:

| Best Hand | Pay |
|---|---|
| 4 of a Kind | 50 |
| AKQ Suited | 12 |
| Straight Flush | 6 |
| 3 of a Kind | 5 |
| Straight | 2 |

An alternate example bonus pay table could be as follows:

| Best Hand | Pay |
|---|---|
| 4 of a Kind | 50 |
| AKQ Suited | 20 |
| Straight Flush | 6 |
| 3 of a Kind | 4 |
| Straight | 2 |

Additionally or alternatively, a bonus wager on the player cards may be conducted. In such an optional embodiment, a bonus wager is paid if the two cards dealt to the player, i.e. the player cards excluding any community cards, form a bonus holding. An example bonus pay table using Blackjack rankings based on the sum of the values of the player cards for such a bonus wager could be as follows:

| Player cards | Pay |
|---|---|
| Pair of Aces + Ace in community cards | 100 |
| Pair of Aces | 30 |
| Suited Blackjack | 10 |
| Unsuited Blackjack | 5 |
| Any Pair (Excluding Aces) | 3 |
| Any 20 (Excluding Ace plus nine) | 2 |

Other example paytables could be as follows:

| Player cards | Pay |
|---|---|
| Pair of Aces | 33 |
| Suited Blackjack | 12 |
| Unsuited Blackjack | 5 |
| Any Pair (Excluding Aces) | 3 |
| Any 20 (Excluding Ace plus nine) | 2 |

Another example of a bonus pay table is based on the player's two hole cards and the three community cards. The bonus bet wins if the five cards match any of the following predetermined five-card poker winning combinations:

| Player cards | Pay |
|---|---|
| Straight Flush | 100 |
| 4 of a Kind | 50 |
| Full House | 40 |
| Flush | 30 |
| Straight | 20 |
| 3 of a Kind | 7 |
| Two Pair | 3 |
| Pair of 9's or Better | 1 |

In an embodiment of four card hold'em, the player may also be given the option to place a bonus wager before any cards are dealt. In an optional embodiment, the bonus wager wins if the player's best four card poker hand is a straight or better. A pay table for the side wager may optionally be as follows:

| Best 4-Card Hand | Pay |
|---|---|
| AKQJ Suited | 50 to 1 |
| 4 of a Kind | 40 to 1 |
| Straight Flush | 30 to 1 |
| 3 of a Kind | 5 to 1 |
| Flush | 2 to 1 |
| Straight | 2 to 1 |

Other example paytables could be as follows:

| Best 4-Card Hand | Pay |
|---|---|
| AKQJ Suited | 50 to 1 |
| 4 of a Kind | 40 to 1 |
| Straight Flush | 25 to 1 |
| 3 of a Kind | 5 to 1 |
| Flush | 2 to 1 |
| Straight | 2 to 1 |
| AKQJ Suited | 50 to 1 |
| 4 of a Kind | 40 to 1 |
| Straight Flush | 20 to 1 |
| 3 of a Kind | 5 to 1 |
| Flush | 2 to 1 |
| Straight | 2 to 1 |

While certain embodiments of the present invention have been shown and described it is to be understood that the present invention is subject to many modifications and changes without departing from the spirit and scope of the claims presented herein.

I claim:

1. A method for conducting a game of chance for a player, comprising:

providing a physical deck of cards;

receiving a game wager from said player for participation in said game;

conducting a first stage of said game of chance, said first stage comprising:

dealing one or more player cards; and dealing one or more unexposed banker cards;

after conducting said first stage, receiving from said player a game decision of placing an additional game wager or folding and forfeiting said game wager;

after receiving said game decision, conducting an additional stage of said game comprising exposing at least one community card;

after said additional stage, receiving from each player an additional game decision consisting essentially and only of placing a second additional game wager or checking;

exposing at least one additional community card and exposing said banker cards;

comparing a player hand formed from a subset of said player cards plus said community cards to a banker hand formed from a subset of said banker cards plus said community cards; and resolving said game by issuing a reward to said player based on said game wager, said additional game wager, and said second additional game wager if any if said player hand outranks said banker hand, and collecting said game wager, said additional game wager, and said second additional game wager, if any, from said player if said banker hand outranks said player hand.

2. The method of claim 1 wherein said step of resolving said game further comprises collecting said game wager, said additional game wager, and said second additional game wager, if any, from said player if said banker hand ties said player hand.

3. The method of claim 1 wherein said step of resolving said game further comprises returning to said player said game wager, said additional game wager, and said second additional game wager, if any, from said player if said banker hand ties said player hand.

4. The method of claim 1 further comprising defining a pay table of payouts and associated player hands such that said reward includes a payout from said pay table based on said player hand and said game wager.

5. The method of claim 1 wherein said reward includes a payout of even money based on said additional game wager and said second additional game wager, if any.

6. The method of claim 1 wherein if said banker cards are equal to, or greater than, a predetermined rank, said reward includes a payout of even money based on said additional game wager and said second additional game wager, if any, and if said banker cards are less than a predetermined rank, said reward includes only a return of said additional game wager and said second additional game wager, if any, to said player.

7. The method of claim 1 further comprising:

defining a bonus pay table of bonus hands and associated bonus awards;

receiving an optional bonus wager from said player before said first stage; and in resolving said game, comparing said player hand to said bonus pay table and if said player hand is a bonus hand, issuing said associated bonus award to said player.

8. The method of claim 1 further comprising:

defining a bonus pay table of bonus combinations and associated bonus awards;

receiving an optional bonus wager from said player before said first stage; and in resolving said game, comparing said player cards to said bonus pay table and if said player cards a bonus combination, issuing said associated bonus award to said player.

9. The method of claim 1 wherein said first stage includes dealing two player cards, dealing two unexposed banker cards, and exposing one community card.

10. The method of claim 9 wherein a total of three community cards are exposed such that said player hand is formed from three of the cards selected from the two player cards and three community cards and said banker hand is formed from three of the cards selected from the two banker cards and three community cards.

11. The method of claim 1 wherein said first stage further comprises exposing at least one community card.

12. The method of claim 1 wherein said first stage includes dealing three player cards, dealing three unexposed banker cards, and exposing one community card.

13. The method of claim 12 wherein a total of three community cards are exposed such that said player hand is formed from four of the cards selected from the three player cards and three community cards and said banker hand is formed from four of the cards selected from the three banker cards and three community cards.

14. The method of claim 1 wherein said first stage includes dealing two player cards, and dealing two unexposed banker cards.

15. The method of claim 14 wherein a total of four community cards are exposed such that said player hand is formed from four of the cards selected from the two player cards and four community cards and said banker hand is formed from four of the cards selected from the two banker cards and four community cards.

16. The method of claim 15 further comprising:

comparing the higher player card to the higher banker card if the player hand and banker hand are both formed from the four community cards; and rewarding said player if said higher player card outranks said higher banker card.

17. A method for conducting a game of chance for a plurality of players, comprising:

providing a physical deck of cards:

receiving a game wager from each player for participation in said game;

conducting a first stage of said game of chance, said first stage comprising dealing one or more player cards to each player;

after conducting said first stage, receiving from said player a game decision of placing an additional game wager or folding and forfeiting said game wager;

after receiving said game decision, conducting an additional stage of said game comprising exposing at least one community card;

after said additional stage, receiving from each player an additional game decision consisting essentially and only of placing a second additional game wager or checking;

exposing at least one additional community card;

comparing player hands formed from a subset of each player's player cards plus said community cards to determine the highest ranking player hand; and resolving said game by issuing a reward to said player having the highest ranking player hand, and collecting said game wager, said additional game wager, and said second additional game wager, if any, from players not having the highest ranking player hand.

18. The method of claim 17 further comprising:

defining a bonus pay table of bonus hands and associated bonus awards;

receiving an optional bonus wager from said player before said first stage; and in resolving said game, comparing said player hand to said bonus pay table and if said player hand is a bonus hand, issuing said associated bonus award to said player.

19. The method of claim 17 further comprising:

defining a bonus pay table of bonus combinations and associated bonus awards;

receiving an optional bonus wager from said player before said first stage; and in resolving said game, comparing said player cards to said bonus pay table and if said player cards a bonus combination, issuing said associated bonus award to said player.

20. The method of claim 17 wherein said first stage includes dealing two player cards to each player and exposing one community card.

21. The method of claim 20 wherein a total of three community cards are exposed such that each player hand is formed from three of the cards selected from the two player cards and three community cards.

22. The method of claim 17 wherein said first stage further comprises exposing at least one community card.

23. The method of claim 17 wherein said first stage includes dealing three player cards to each player and exposing one community card.

24. The method of claim 23 wherein a total of three community cards are exposed such that each player hand is formed from four of the cards selected from the three player cards and three community cards.

25. The method of claim 17 wherein said first stage includes dealing two player cards to each player.

26. The method of claim 25 wherein a total of four community cards are exposed such that each player hand is formed from four of the cards selected from the two player cards and four community cards.

27. The method of claim 26 further comprising:

comparing the higher player card held by each player if two or more player hands are each formed from the four community cards; and rewarding the player having the highest ranking player card.

* * * * *